United States Patent [19]

Graham

[11] Patent Number: 4,497,180

[45] Date of Patent: Feb. 5, 1985

[54] METHOD AND APPARATUS USEFUL IN COOLING HOT STRIP

[75] Inventor: Howard A. Graham, Belleville, Ill.

[73] Assignee: National Steel Corporation, Pittsburgh, Pa.

[21] Appl. No.: 594,817

[22] Filed: Mar. 29, 1984

[51] Int. Cl.[3] ..... F25D 13/06

[52] U.S. Cl. ..... 62/63; 62/64; 62/374; 72/201; 148/143; 148/153

[58] Field of Search ..... 62/63, 64, 374, 375; 148/153, 156, 143; 72/201

[56] References Cited

U.S. PATENT DOCUMENTS

| | | | |
|---|---|---|---|
| 3,289,449 | 12/1966 | O'Brien | 72/201 |
| 3,479,853 | 11/1969 | Berry | 72/128 |
| 3,589,160 | 6/1971 | Gruver et al. | 148/156 |
| 3,604,234 | 9/1971 | Hinrichsen et al. | 72/13 |
| 4,047,985 | 9/1977 | Greenberger | 148/153 |
| 4,065,252 | 12/1977 | Hemsath et al. | 62/64 |
| 4,439,990 | 4/1984 | Leloux | 62/64 |

*Primary Examiner*—Ronald C. Capossela

*Attorney, Agent, or Firm*—O'Neil and Bean

[57] ABSTRACT

A method of and apparatus for controlling the flow of cooling water to the top of a hot metal strip on a runout table is disclosed. Cooling water is continuously discharged from nozzles in spray bars above the strip and cooling is controlled by selectively diverting the water from selected ones of the spray bars to control the volume and location of the water applied. Movable deflector plates are mounted adjacent predetermined spray bars and actuators are provided to selectively move the deflector plates to deflect water into a fixed trough to be diverted from the top of the strip.

26 Claims, 7 Drawing Figures

METHOD AND APPARATUS USEFUL IN COOLING HOT STRIP

BACKGROUND OF THE INVENTION

1. Field of the Invention

This invention relates to cooling of hot metal strip and more particularly to an improved method of and apparatus for cooling hot metal strip on the runout table of a hot strip finishing mill.

2. Description of the Prior Art

Metal strip produced on a hot strip finishing line is conventionally coiled by coilers spaced a substantial distance from the final stand of the finishing line. A runout table in the form of a driven roller conveyor supports the strip as it moves at high speeds from the stand to the coiler. The temperature of the strip issuing from the final roll stand however is too high for coiling and it is therefore necessary to cool the strip in its path along the runout table to avoid undesired metallurgical changes in the coil.

Strip issuing from a finishing mill is travelling at high rates and therefore rapid cooling on the runout table is required to avoid the necessity of an abnormally or unacceptably long runout table. Cooling is usually accomplished at a plurality of water spray stations or banks located along the runout table, with cooling water being applied both to the top and bottom surfaces of the strip. The bottom surface is cooled by spray bars positioned closely adjacent the strip, with the cooling water serving also to cool the metal surface of the conveying rollers. However, cooling water must be applied to the top of the strip from water delivery means spaced a substantial distance above the runout table in order to provide access to strip on the table and to avoid damage to the cooling system by cobbles which occasionally occur on the runout table as explained, for example, in U.S. Pat. No. 3,479,853.

In a typical hot strip finishing line, each cooling station includes a plurality of spray bars extending transversely of the strip above and below the runout table, with cooling water being directed onto the surface of the hot strip from a plurality of nozzles spaced along the length of each spray bar. The respective banks may consist of 10 to 12 individual spray bars above and below the strip with each spray bar being connected to a manifold supplied with water from a pressurized source, usually a separate pump for each bank, and valving is provided to control the flow of water to the individual banks. Preferably at least selected ones of the banks of spray bars also include valving to enable half sections of the bank to be selectively turned on and off to enable better control of strip cooling. In one hot strip finishing line operated by the assignee of the present invention, ten banks of twelve spray bars are provided above the strip with each bank receiving up to 3000 g.p.m. for a total water capacity of 30,000 g.p.m. applied to the top of the strip if all banks are operated simultaneously. This, of course, is in addition to the cooling water supplied to the bottom surface of the hot strip. The cooling water is recirculated and is therefore relatively hot and can be contaminated. Cooling systems having substantially greater water capacity are known and may be required particularly for heavier gauge strip or for strip leaving the final roll stand at higher temperatures or higher speeds.

Using the prior art system just described, it is generally possible to control the temperature only within the range of about 100° F., or to about 50° above or below the optimum or target temperature. In such a high volume water supply system, the valving necessarily requires substantial time to open or close during which time the flow rate varies, and upon closing there is a period of drainage or siphoning of the system during which some cooling water continues to flow from a closed bank. In a typical eight-hour shift, the valves might be actuated 250 or more times so that the valves, actuators and controls present a continuous maintenance problem.

One of the problems encountered in cooling hot strip is the difficulty in penetrating the layer of rapidly expanding steam which develops adjacent the hot top surface. Substantial water pressure is required, although excessive pressure may result in the cooling water being broken up into small droplets having insufficient inertia or momentum to penetrate the steam layer. A solution to this problem which is widely used in the industry, is the so-called laminar flow nozzle disclosed in U.S. Pat. Nos. 3,025,865 and 3,294,107 and which discharges water in a medium pressure coherent stream. By utilizing a plurality of such nozzles in closely spaced relation on each spray bar, the parallel streams of water penetrate the steam layer, effectively applying coolant across the complete width of the strip as it passes beneath each spray bar. Such laminar flow nozzles of course require relatively close control of water pressure and may be ineffective or only partially effective during periods of opening and closing of conventional header valves.

The use of quick-acting valves in each spray bar has also been considered as a means of avoiding the time delays inherent in systems which supply water either to a full or half bank of spray bars under control of a single cutoff valve. However, such systems introduce other problems including water surge in open lines when a valve controlling all or part of a bank is activated suddenly and water hammer in the headers and supply lines when a full bank is suddenly shut off. Also, the large number of fast acting valves in a system using contaminated cooling water, and the corresponding large number of controls and actuators required, present serious maintenance problems.

In an effort to overcome these problems, at least one attempt has been made to control the cooling rate while providing a continuous flow of water from the spray bars of a predetermined number of headers and by selectively deflecting the water from selected headers by use of a system of movable troughs supported above the strip. Power means move the troughs between a first position spaced from the spray bars to permit the water to descend onto the hot strip and a second position beneath the spray bars to catch the water and lead it over the side of the strip. Such a system does not provide a satisfactory solution, however, for various reasons. For example, relatively large troughs were required since water flow from a single spray bar could be up to 300 gallons per minute or more. The water discharged into the trough from relatively high pressure nozzles creates substantial turbulence in the trough and movement of the trough results in substantial spilling or splash-over from the trough itself. Further, since movement of the troughs necessarily has to be relatively slow, excessive spray is created during movement of the edge of the trough through the water streams. Such system also requires elaborate and heavy equipment to support and move the heavy troughs and due to the relatively large size and weight of the overall system, it is inherently slow acting. The relatively large troughs and their support system also presents substantial interference in the space above the runout table. Obvious difficulties with such a system may account for it apparently never having been widely accepted commercially.

A primary object of the present invention is, therefore, to provide an improved method and apparatus useful in the cooling of hot strip on a runout table.

Another object is to provide such a method and apparatus which enables a more positive and accurate temperature control and which avoids the foregoing and other problems encountered in the prior art cooling systems.

SUMMARY OF THE INVENTION

The foregoing and other objects and advantages are achieved in accordance with the present invention in which a plurality of banks of spray bars extend above the strip on a runout table, with the cooling water being directed onto the top surface of the hot strip from nozzle outlets spaced along the length of the respective spray bars. A system of fixed troughs are rigidly mounted adjacent the downwardly directed streams of cooling water issuing from the nozzle on the spray bars of at least selected ones of the banks of top spray bars, with the troughs being adapted to direct water therein laterally over the side of a hot strip moving on the runout table. A system of elongated deflector plates or blades are pivotally mounted one adjacent to but slightly above one side edge of each trough for pivotable movement from a retracted position spaced from the streams issuing from the nozzles of the associated spray bar and a deflecting position extending beneath such streams and acting to deflect the streams into the trough. Fast acting actuator means are provided to quickly move the deflector blades between the respective positions to give very quick positive control of the streams of cooling water issuing from a selected spray bar or group of spray bars. Since the troughs are rigidly fixed, no splashing of water results from movement of a substantially full trough. Also, the trough may include means for preventing splash-over of water as a result of the high pressure streams being directed into the trough.

Since only lighweight deflector plates are moved, lightweight actuators may be employed, thereby reducing the size of the controls and the amount of power required for actuation. In one activator system currently being evaluated, positive shutoff without drainage requires less than one half second. The actuators are reliable, long-lasting air cylinders which are relatively inexpensive. This system has been proven to enable the control of temperature of the strip to within the range of approximately one half that previously obtainable, i.e., to within about 25° of the target temperature. The system is well adapted for computer controlled monitoring for completely automatic operation. Using this system enables the pumps to be operated continuously to provide continuous flow of water through all the spray bar nozzles in each bank being used thereby eliminating water hammer, water surge and siphoning. Further, maintenance of the system is greatly simplified since no water valves need be opened or closed in a normal operating cycle. This system enables any combination of spray bars in a bank to be used for cooling as desired.

BRIEF DESCRIPTION OF THE DRAWINGS

Other features and advantages of the invention will be apparent from the detailed description contained hereinbelow, taken in conjunction with the drawings, in which.

DESCRIPTION OF THE PREFERRED EMBODIMENT

Figure 1:
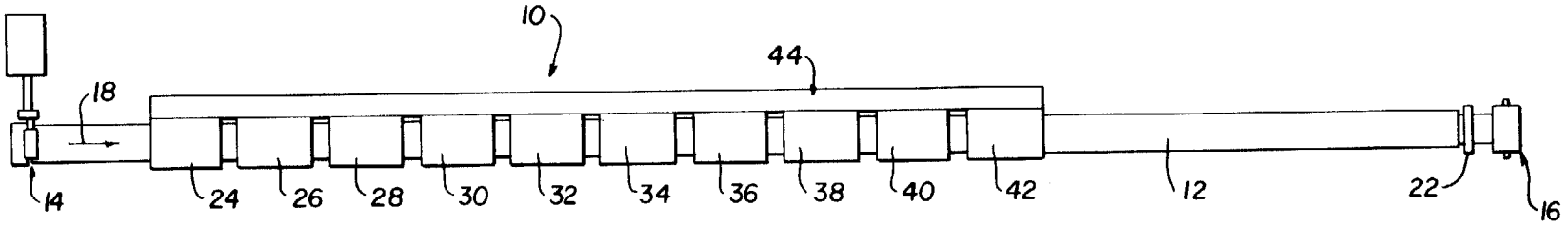
FIG. 1 is a plan view schematically showing a runout table and cooling station of a hot strip finishing mill.
Figure 2:
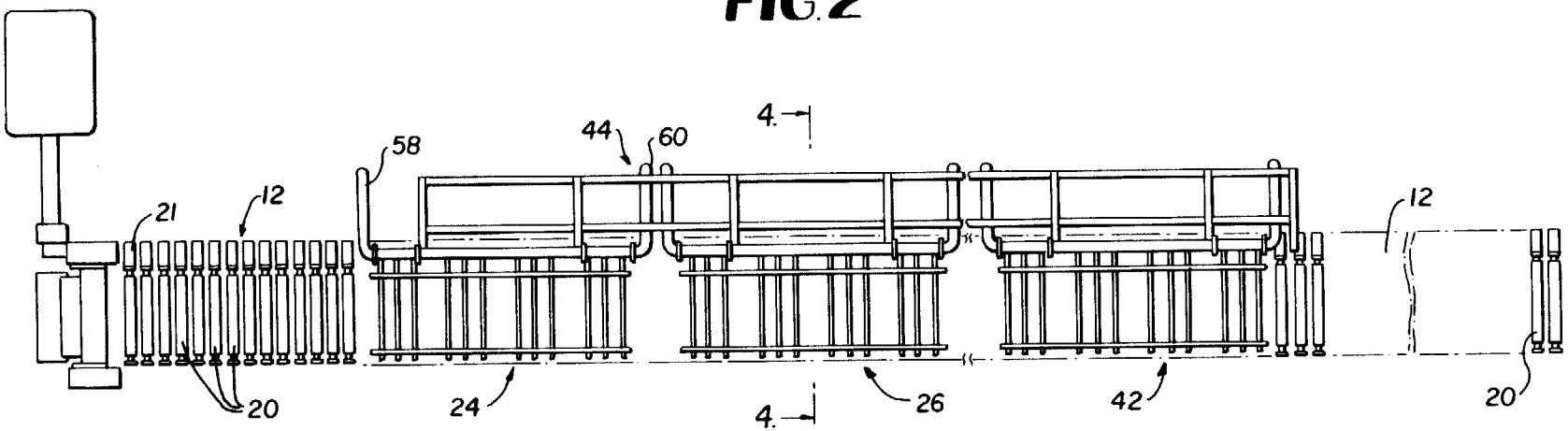
FIG. 2 is an enlarged view of a portion of the structure shown in FIG. 1 and illustrating three banks of cooling water spray bars extending above the runout table.

Referring now to the drawings in detail, apparatus for conveying and cooling hot metal strip from the final stand of the finishing mill to the coiler is designated generally by the reference numeral 10 and comprises an elongated runout table 12 extending between the final roll stand 14 of the mill and a coiler 16 at the opposite end of the runout table. Hot strip leaves the roll stand 14 and moves in the direction of arrow 18 over the runout table which comprises a driven roller conveyor made up of a series of parallel rollers 20 driven by suitable means such as motors 21. The rollers 20 support the strip in a flat, horizontal condition in its path from the roll stand to the coiler. A pair of driven pinch rolls 22 are located at the end of the runout table near the coiler 16 to engage and draw the strip along the table and to maintain the strip under tension in the conventional manner.

In a normal installation, runout table 12 will be several hundred feet long, and a water cooling system consisting of a number of banks of water spray bars are located between mill stand 14 and coiler 16. A typical installation may include ten banks of spray bars, the banks being indicated by reference numerals 24, 26, 28, 30, 32, 34, 36, 38, 40 and 42 in FIG. 1, with the respective banks being connected to suitable water headers indicated generally at 44 in FIG. 1. Typically, hot strip leaving the mill stand 14 will pass over table 12 for some predetermined distance to permit limited radiation and convection cooling before reaching the first bank of spray bars 24. Similarly, after the strip exits the last bank 42, it will pass over a substantial length of runout table 12 for open air cooling and temperature stabilization before being coiled by coiler 16.

Figure 3:
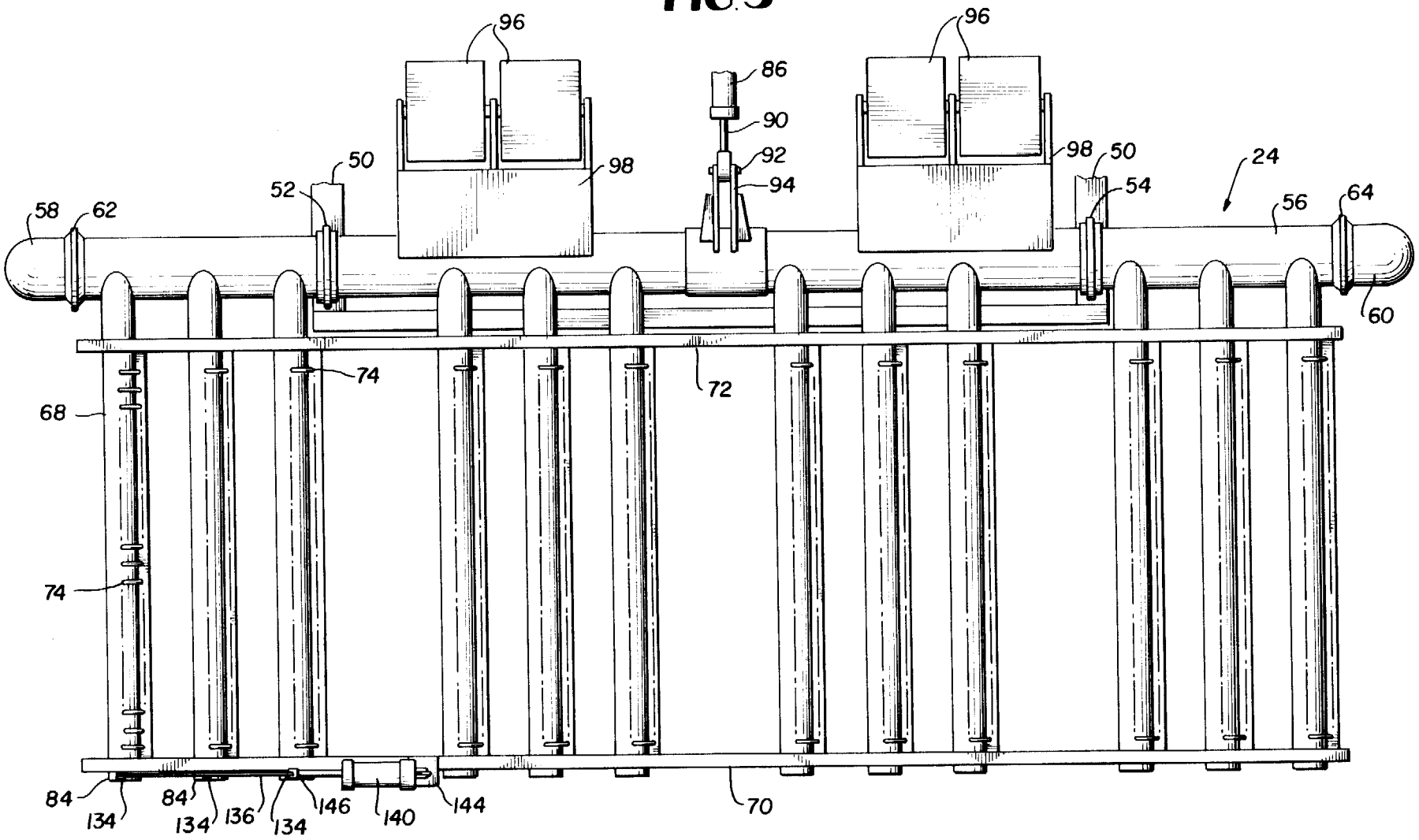
FIG. 3 is a further enlargement of a portion of the structure shown in FIG. 2 and illustrating a single bank of spray bars incorporating the present invention.

Each of the cooling stations may be substantially identical and therefore only the cooling station 24 will be described in detail, it being understood that the description applies equally to all cooling stations. Thus, referring to FIGS. 3 and 4, a rigid, open beam frame assembly 46 extends along one side edge of the runout table and projects upwardly therefrom to support the portion of the cooling water system which directs water downward onto the top surface of a strip 48 supported on rollers 20. Frame 46 includes a ledge or shelf portion 50 supporting a pair of spaced bearing plate assemblies 52, 54 which, in turn, rotatably support an elongated water header 56 extending in parallel relation to the longitudinal axis of the runout table. Water under pressure is supplied to header 56 from a suitable source such as a pump, not shown, through conduits 58, 60 which are rotatably connected one to each end of the header through seal assemblies 62, 64, respectively.

Header 56 is a relatively large diameter pipe, for example, a 12" ID pipe capable of handling a high volume of water for discharge onto the top of the strip 48. A plurality of spray bars each have one end rigidly welded on and in fluid communication with header 56, with the spray bars projecting in spaced parallel relation to one another and in vertically spaced generally parallel relation to the top surface of the runout table. The respective spray bars 68 are retained in their spaced parallel relation and reinforced by a pair of channel members 70, 72 with channel member 70 being joined adjacent the distal ends of the respective spray bars and channel member 72 extending adjacent the ends of the spray bars joined to manifold 56.

Figure 4:
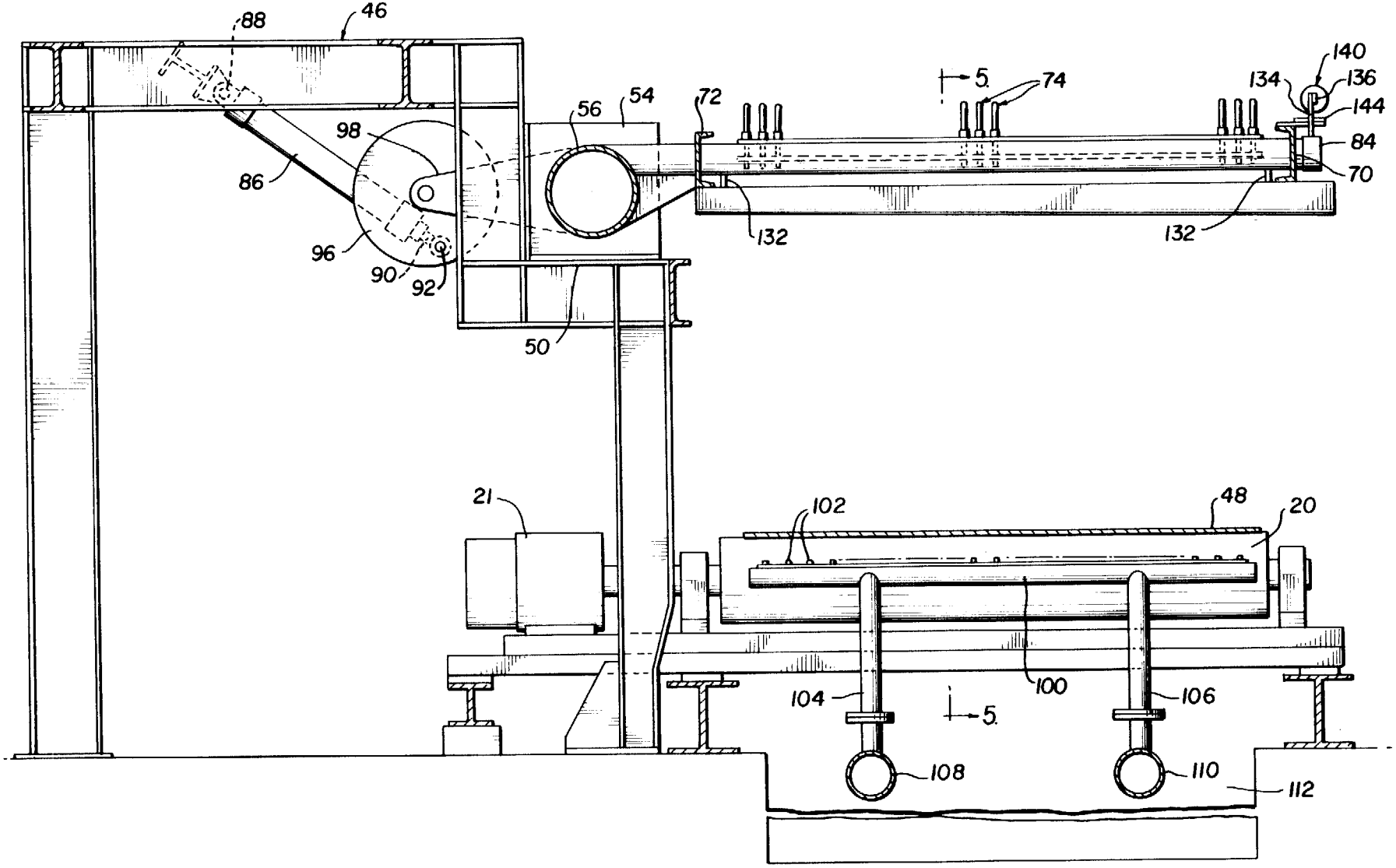
FIG. 4 is a sectional view taken along line 4—4 of FIG. 3.

Each spray bar 68 has a plurality of outlet nozzle pipes 74 supported on and in fluid communication with the interior of the spray bar. Each nozzle 74 comprises a coupling 76 rigidly welded on the spray bar 68, and an inverted U-tube 78 having an outlet portion directed vertically downward and terminating in an open end 79. The length and configuration of the U-tube 78 is such as to discharge water in a laminar flow stream as indicated at 80, with the streams 80 being sufficiently coherent and having sufficient velocity to effectively penetrate the layer of steam above hot strip 48 to cool the strip. Such nozzles, generally referred to in the industry as laminar flow nozzles, are well known. The outlet end portions of the U-tubes are retained in aligned relation by a guide bar 82 extending along and being welded to the side of the respective spray bars 68. As shown in FIG. 4, the distal ends of the respective spray bars 68 are closed by suitable means such as a cap 84.

It is desirable to be able to displace the top banks of spray bars from their use position shown in FIG. 4, as when repairing the runout table or clearing a cobble from the runout table. To accomplish this, the manifold 56 and spray bars 64 may be rotated about the longitudinal axis of manifold in the bearing assemblies 52, 54 by a fluid actuator having its cylinder 86 connected, as by pin 88, to a rigid bracket on frame 46 and its piston 90 connected as by pin 92 to a pivot bracket 94 rigidly welded on the manifold 56. To assist in moving the upper spray bank, counterweights 96 may be supported on brackets 98 rigidly welded on and projecting outwardly from manifold 56 in a direction generally opposite to the spray bars. Rotation of manifold 56 is permitted by the rotary seal assemblies 62, 64.

Figure 5:
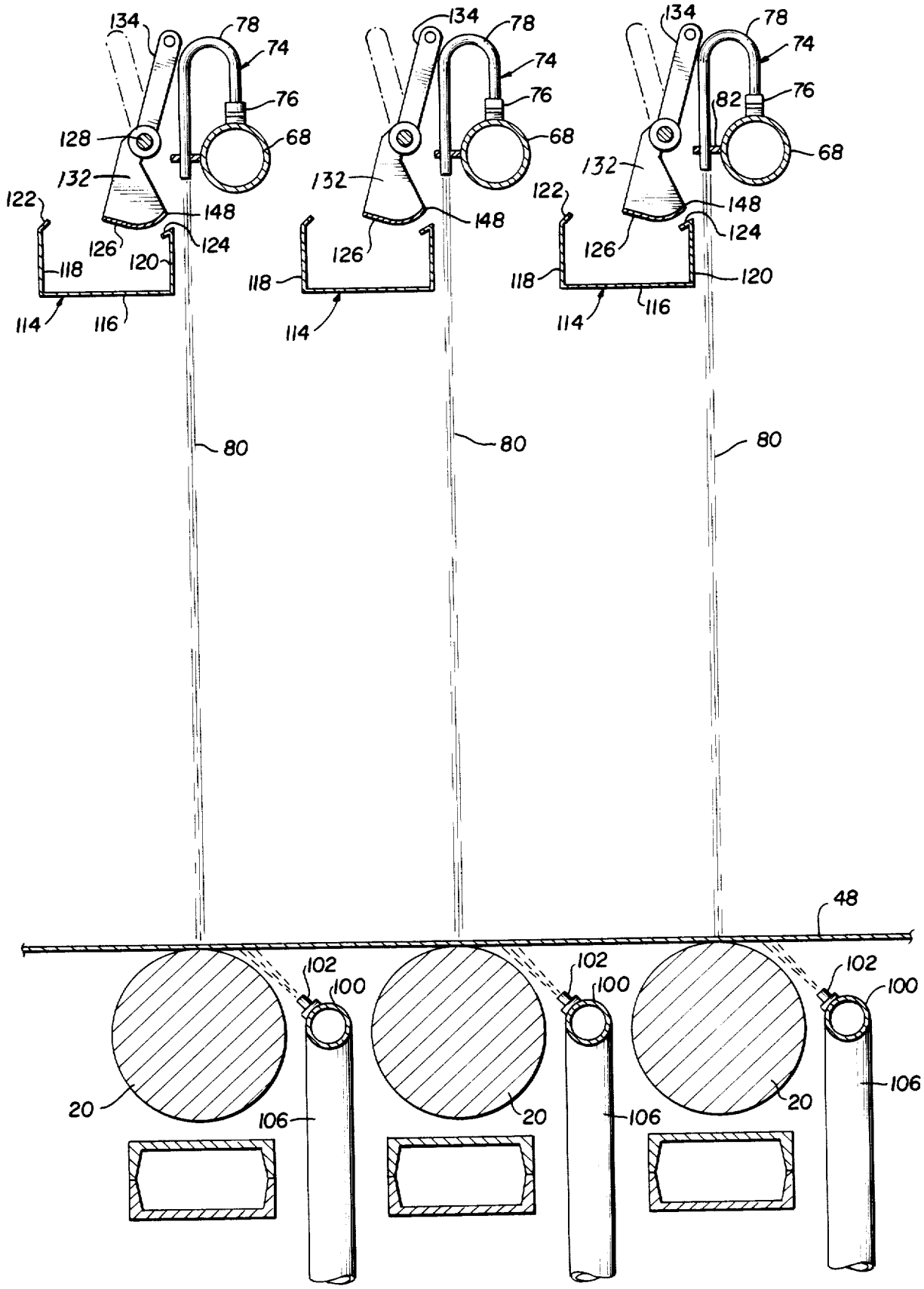
FIG. 5 is an enlarged sectional view taken along line 5—5 of FIG. 4.

As seen in FIGS. 4 and 5, each spray bar cooling station also includes a bottom bank of spray bars 100 each having a plurality of discharge nozzles 102 for discharging water in a stream or spray against the bottom surface of strip 48 to cool the strip and to simultaneously cool the surface of rolls 20. Spray bars 100 are supplied with water under pressure by risers 104, 106 connected to a pair of water supply manifolds 108, 110, respectively, extending beneath the runout table. The water falls by gravity into a sump 112 beneath the runout table for recirculation, as does the water discharged from the top bank of spray bars.

The cooling system thus far described is conventional in the art. In such systems, the spray bars 68 may be formed from lengths of 6" ID pipe, while the header 56 may be formed from 12" ID pipe, or even larger pipe to enable flow rates through the headers of up to several thousand gallons per minute. Thus, it is apparent that from a practical standpoint, water flow from a particular top bank of spray bars cannot be quickly stopped and started as is desired for maximum control of temperature of strip 48.

Referring now particularly to FIGS. 4–7, apparatus according to the present invention for providing substantially instantaneous on and off control of water flow from individual top spray bars, or selected groups of top spray bars in the bank will be described. In accordance with this invention, a plurality of individual water troughs 114 are supported on the upper spray bar bank one beneath and at one side of each spray bar 68 of at least selected ones of the upper spray bar banks. Troughs 114 have their end portions rigidly mounted on channel members 70, 72 and extend in generally parallel spaced relation to the spray bars above the runout table. Troughs 114 each have their inwardly directed end, i.e., the end closest to frame 46, closed by an end wall 17, with the opposite end of the trough being open so that water collected in the trough in the manner described hereinbelow can run freely out of the trough and be discharged to fall downwardly at the side of strip 48 and drain into sump 112. If desired, suitable baffles, not shown, may be provided on the side of the runout table or on the floor to minimize the splash of the water and to assist in directing the water into the sump for recirculation.

Troughs 114 each have a downwardly inclined bottom wall 116 and upwardly directed, laterally spaced sidewalls 118, 120, with wall 120 being located closely adjacent to the vertical plane containing the outlet opening 79 of the laminar flow nozzles 74 of the associated spray bar 68, with the top of wall 120 being located below the outlet of the nozzles. Sidewalls 118, 120, respectively terminate at their top ends in inwardly directed flanges 122, 124, respectively, contoured to minimize splash as more fully described hereinbelow.

A plurality of elongated, curved deflector blades 126 are mounted one adjacent to the open top of each trough 114. Deflector blades 126 extend transversely of the runout table 12 and have a length slightly greater than the length of the row of nozzles 74 on the respective spray bars 68. Deflector blades 126 are each supported on a shaft 128 rotatably mounted in a pair of bearing assemblies 130 which, in turn, are mounted one on each of the channel members 70, 72. A plurality of support arms or brackets 132, preferably formed from metal plate, extend between and are rigidly joined to deflector 126 and shaft 128 whereby rotation of the respective shafts will produce rotation of the deflector blades 126 about the axis of the associated shaft.

Figure 7:
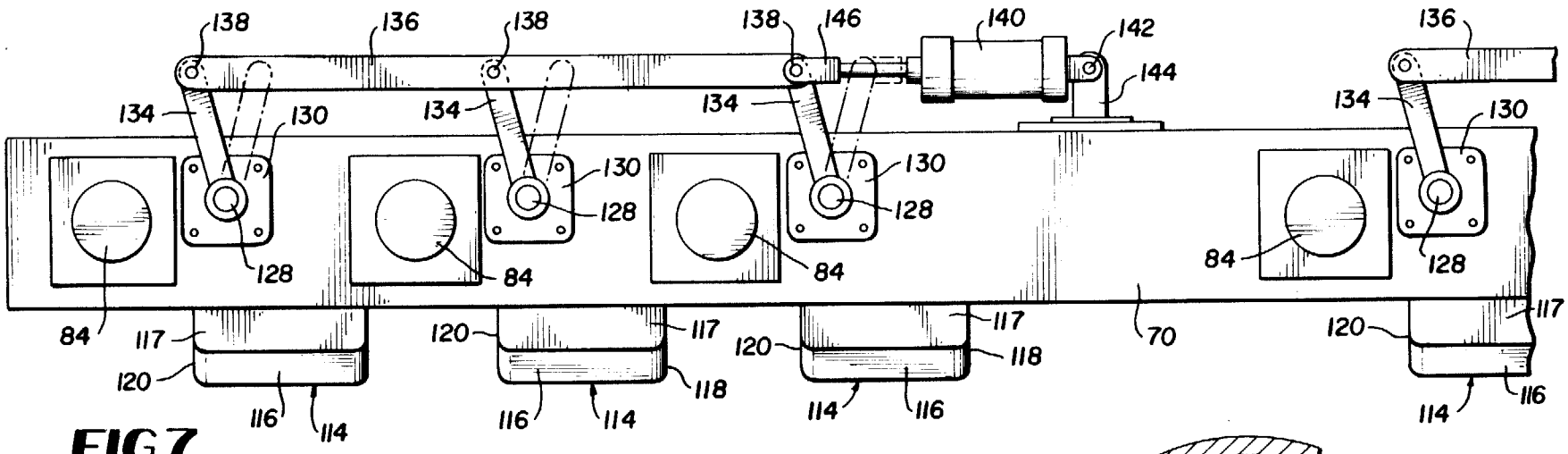
FIG. 7 is a fragmentary elevational view showing the actuation mechanism employed to operate the water diverting structure shown in FIGS. 5 and 6.
Figure 6:
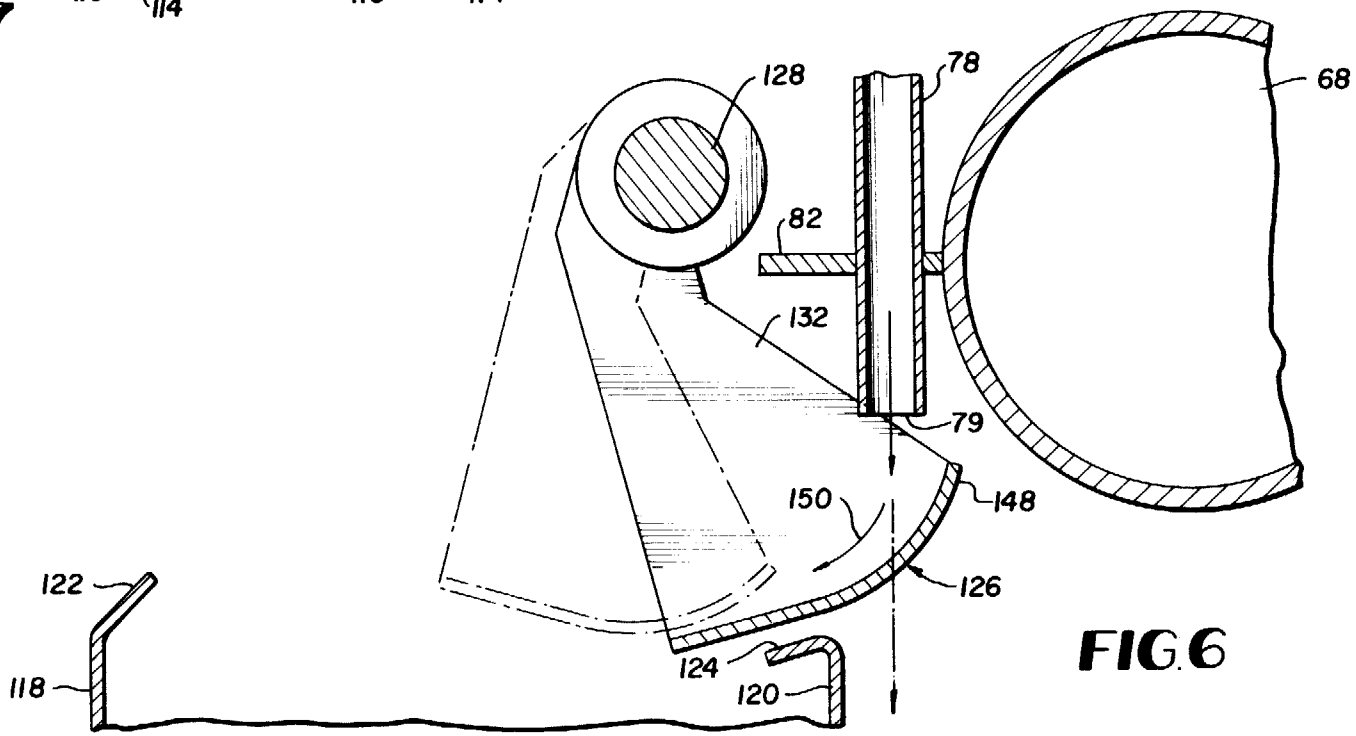
FIG. 6 is a further enlargement of a portion of the structure shown in FIG. 5.

As best seen in FIGS. 5 and 7, an upwardly extending lever arm 134 is fixed on one end portion of each shaft 128 to rotate the shafts to selectively move deflector plates 126 between the full line and the broken line positions shown in FIG. 6. Preferably, the deflector plates of each upper spray bank equipped with the invention are connected in groups of three for simultaneous actuation as illustrated in FIG. 7. This is accomplished by connecting the upwardly extending end portion of the lever arms 134 of three adjacent deflector plate support shafts 128 to a common actuating arm 136, as by pivot pins 138. Actuating arm 136 is adapted to be moved longitudinally of itself to move the arms 134 between the full line and broken line position of FIG. 7 by a fast acting air actuator 140 having its cylinder end connected as by pin 142 to a pivot bracket 144 rigidly mounted on top of channel member 70 and its piston end connected through clevis 146 and pin 138 to actuator arm 136.

Referring to FIGS. 5 and 7, when the actuator 140 is extended to move the arms 134 to the full line position, water under pressure in spray bars 68 will be discharged through the outlet 79 of laminar flow nozzle assemblies 74 and directed downward in parallel coherent streams 80 to impinge upon the top surface of the hot strip 48 on the runout table. Streams 80 pass in close proximity to the sidewall 120 of the respective troughs 114 and to the curved edge portion 148 of deflector blade 126. In this position, the deflector blade and trough present no interference with the flow of cooling water and the troughs 114 actually present a protective barrier to the nozzle assemblies 74 in the event of cobbling on the runout table. When it is desired to cut off the flow of water from a particular group of top spray bars, the actuating cylinder 140 associated with that group is energized to retract its piston rod, thereby moving arms 134 from the full line to the broken line positions in FIGS. 5 and 7, and moving deflector blade 126 from the broken line to the full line position shown in FIG. 6. The curved edge portion of deflector blade swinging in an arc about the axis of shaft 128, under force of the quick acting cylinder 140, cuts almost instantaneously through the streams 80, completely and positively cutting off the flow onto the hot strip 48 and diverting the water in the direction of arrow 150 into the trough 114. The arcuate portion of deflector blade 126 acts to smoothly divert the stream of water and prevent excessive spray or backwash over the edge so that all water discharged from the associated nozzles 74 flows in the associated trough.

The inwardly directed edges 122, 124 at the open top side of the trough serve to catch and redirect back into the trough any water splashed upward to the top. As indicated in FIGS. 4 and 7, the bottom wall 116 of the respective troughs is inclined toward the open or discharge end to enable the water to quickly drain over the side of the runout table so that the volume of water diverted into the trough can be accommodated by a relatively shallow structure.

It is apparent that any number of spray bars can be connected together for simultaneous actuation, and that the use of fast acting air cylinders gives extremely quick on and off control of cooling water to the hot strip. It is contemplated, for example, that a portion of one top spray bank, for example, three spray bars, may be adapted to be actuated individually whereas the remaining top spray bars of that bank may be connected together in groups of three. Also, preferably more than one top bank is equipped with the invention and conceivably all banks may be so equipped. For example, one or two banks may be connected so as to enable control of the flow from a half bank by actuation of a single control cylinder. This system therefore lends itself extremely well to computer control, with the computer taking its signals from pyrometers located along the runout table in the usual manner and calculating the appropriate combination of spray bars, both in terms of numbers and location, to produce the desired strip cooling. Experimentation has shown that this enables much closer control of strip temperature than was available by the prior art procedure of shutting down or opening valves or pumping circuits to control water flow. Also, by continuously operating the pumping system, maintenance of the system is greatly reduced. Testing has shown that only about one half second is required to actuate the cylinder 140 to completely cut off the flow from a desired spray bar or group of spray bars whereas closing or opening a valve in a relatively large pipe such as a 12" diameter manifold pipe, or even a 6" diameter spray bar necessarily required substantial time in order to prevent water surge or water hammer.

While the invention has been described with regard to a runout table and cooling system employing laminar flow cooling water nozzles, it should be apparent that the invention may be employed with any type of cooling water spraying apparatus suitable for use on the top banks of a runout table cooling system. Also, while a preferred embodiment of the invention has been disclosed and described, it should be apparent that the invention is not so limited and it is therefore intended to include all embodiments which would be apparent to one skilled in the art and which come within the spirit and scope of the invention.

I claim:

1. In a hot strip finishing line having a runout table extending between the final mill stand and coiler and a cooling water system for cooling hot strip metal moving on the runout table, the cooling water system including a plurality of water spray bars extending transversely of and above the path of the strip moving over the runout table, a plurality of water discharge nozzles connected in each spray bar for directing cooling water downward onto the top surface of the strip, and means providing water under pressure to the respective spray bars, the improvement comprising, an elongated water trough having water outlet means, means mounting said trough above the runout table and in fixed generally parallel relation with one of said spray bars, said trough having an open top located below and in laterally spaced relation to the nozzles connected in said one spray bar, movable deflector blade means operatively associated with said trough, and actuator means selectively operable to move said deflector blade means between a first position spaced laterally from the nozzles connected in said one spray bar and a second position extending beneath said nozzles in said one spray bar, said deflector blade means in said second position deflecting water discharged from the nozzles connected in said one spray bar into said trough for discharge through said outlet means.

2. The invention according to claim 1, wherein said actuator means comprises reversible power means.

3. The invention according to claim 2, wherein said reversible power means comprises an air activated cylinder.

4. The invention according to claim 1, wherein said deflector blade means comprises an elongated plate member extending transversely of said runout table above said trough and generally parallel to said one spray bar, and means supporting said plate member for reciprocal movement in a generally arcuate path about an axis generally parallel to said one spray bar.

5. The invention according to claim 4, wherein said elongated plate member has a curved, upwardly concave surface in a plane perpendicular to said axis, said curved surface in said second position providing a smooth contoured guide surface engaging and deflecting water discharged from the adjacent nozzles into said trough.

6. The invention according to claim 5, wherein said trough comprises a pair of sidewalls extending transversely of said runout table, each said sidewall terminating at the top of the trough in an inwardly directed flange, said flanges cooperating to minimize spilling of water from the open top of the trough when water is being deflected into the trough by said deflector blade means.

7. The invention according to claim 5, wherein said actuator means comprises reversible power means.

8. The invention defined in claim 1, comprising a plurality of said troughs each mounted above the runout table in said fixed relation to a separate one of said spray bars and to the nozzles connected in the respective spray bars, each said trough having said deflector blade means operatively associated therewith and actuator means selectively operable to move each said deflector blade means between said first and second positions.

9. The invention according to claim 8, wherein said actuator means comprises means selectively operable to simultaneously move a predetermined number of said plurality of deflector blade means between said first and said second positions.

10. The invention according to claim 9, wherein said actuator means comprises reversible power means.

11. The invention according to claim 10, wherein each said deflector blade means comprises an elongated plate member extending transversely of said runout table above said trough and generally parallel to the associated spray bar, and means supporting said plate member for reciprocal movement in a generally arcuate path about an axis generally parallel to the associated spray bar.

12. The invention according to claim 11, wherein said elongated plate members each have a curved, upwardly concave surface in a plane perpendicular to said axis, said curved surface in said second position providing a smooth contoured guide surface engaging and deflecting water discharged from the adjacent nozzles into said trough.

13. The invention according to claim 12, wherein each said trough comprises a pair of sidewalls extending transversely of said runout table, each said sidewall terminating at the top of the trough in an inwardly directed flange, said flanges cooperating to minimize spelling of water from the open top of the trough when water is being deflected into the trough by said deflector blade means.

14. The invention according to claim 8, wherein the spray bars extending transversely of and above the runout table are arranged in a plurality of banks spaced along the runout table, the banks each including a plurality of spray bars, and wherein each spray bar in at least one of said banks of spray bars has one of said troughs mounted in said fixed relation thereto.

15. The invention according to claim 14, wherein said at least one bank comprises at least three spray bars, and wherein said actuator means comprises means operatively connecting three deflector blades in a group for simultaneous movement, and power means for simultaneously moving said group of blades between their respective first and second positions.

16. In a hot strip finishing line including a runout table extending between the final mill stand and coiler and a cooling water system for cooling a hot strip moving on the runout table, the cooling system comprising a plurality of water discharge outlets in each spray bar for directing cooling water downward onto the top surface of a moving strip on the runout table, water supply means for providing water under pressure to the respective spray bars, and cooling water control means operatively associated with a plurality of said spray bars, said control means being selectively operable to collect water discharged from the discharge outlets in the associated spray bars and to divert the collected water from the top surface of the strip, the cooling water control means including a plurality of elongated troughs extending transversely of the runout table, said troughs each having an open top and being mounted one adjacent to and in fixed generally parallel relation with a separate one of said spray bars with the open top being located below and in laterally spaced relation to the water discharge outlets of the associated spray bar, movable water deflector means operatively associated with each said trough and the adjacent spray bar, said deflector means including an elongated water deflecting plate extending in generally parallel relation to the open top of the associated trough and spray bar, and actuator means selectively operable to move the respective deflector blades between a first position displaced laterally from the water discharge outlets in the associated spray bar and a second position extending beneath the water discharge outlets in the associated spray bar, said deflector blades in said second position deflecting water discharged from the water discharge outlets in the associated spray bar into the associated trough to be collected and diverted from the top surface of a strip moving on the runout table.

17. The invention according to claim 16, comprising said cooling water control means operatively associated with each spray bar of at least one of said banks of spray bars.

18. The invention according to claim 17, wherein said actuator means comprises means selectively operable to simultaneously move a predetermined number of said plurality of deflector blade means between said first and said second position.

19. The invention according to claim 18, wherein said actuator means comprises reversible power means.

20. The invention according to claim 16, wherein said deflector blade means comprises an elongated plate member extending transversely of said runout table above said trough and generally parallel to the associated spray bar, and means supporting said plate member for reciprocal movement in a generally arcuate path about an axis generally parallel to the associated spray bar.

21. The invention according to claim 20, wherein said elongated plate member has a curved, upwardly concave surface in a plane perpendicular to said axis, said curved surface in said second position providing a smooth contoured guide surface engaging and deflecting water discharged from the discharge outlets of the associated spray bar.

22. The invention according to claim 21, wherein said trough comprises a pair of sidewalls extending transversely of said runout table, each said sidewall terminating at the top of the trough in an inwardly directed flange, said flanges cooperating to minimize spilling of water from the open top of the trough when water is being deflected into the trough by said deflector blade means.

23. The invention according to claim 22, wherein said actuator means comprises means selectively operable to simultaneously move a predetermined number of said plurality of deflector blade means between said first and said second position.

24. The invention according to claim 23, wherein said actuator means comprises reversible power means.

25. A method of cooling metal strip on the runout table of a hot strip finishing mill in which cooling water is applied to the top surface of hot metal strip moving over the runout table from a plurality of banks of spray bars extending above and transversely of the strip, the respective banks including a plurality of elongated spray bars each having a row of outlet nozzles along its length for discharging water downward onto the hot strip, and means for supplying water under pressure to the respective spray bars to be discharged from the nozzles, the method comprising, continuously discharging water from the nozzles of the spray bars of a plurality of said banks of spray bars, providing a plurality of elongated, open topped troughs one adjacent to and in fixed parallel relation with each of a plurality of spray bars in at least one bank of spray bars, said troughs being located in laterally spaced relation to the row of nozzles in the adjacent spray bar, providing a movable water deflector in operative association with each trough and the adjacent spray bar, selectively moving the water deflectors between a first position providing an unobstructed path for the water discharged from the row of nozzles in the associated spray bar to the top surface of strip moving on the runout table and a second position extending beneath the row of nozzles and deflecting the water discharged therefrom into the associated trough, and permitting the water deflected into the respective trough to flow therefrom without contacting the strip to thereby selectively control both the volume and distribution of cooling water applied to the top surface of the strip.

26. The method defined in claim 25, wherein the step of selectively moving the water deflectors comprises simultaneously moving a plurality of the deflectors to control the flow of cooling water from a plurality of said spray bars.

* * * * *